US009630306B2

(12) United States Patent
Lundgren

(10) Patent No.: US 9,630,306 B2
(45) Date of Patent: Apr. 25, 2017

(54) PRESSURE ACCUMULATOR AND PERCUSSION DEVICE

(71) Applicant: Anders Lundgren, Degerhamn (SE)

(72) Inventor: Anders Lundgren, Degerhamn (SE)

(73) Assignee: CONSTRUCTION TOOLS PC AB, Kalmar (SE)

( * ) Notice: Subject to any disclaimer, the term of this patent is extended or adjusted under 35 U.S.C. 154(b) by 347 days.

(21) Appl. No.: 14/378,875

(22) PCT Filed: Feb. 11, 2013

(86) PCT No.: PCT/SE2013/050111

§ 371 (c)(1),
(2) Date: Aug. 14, 2014

(87) PCT Pub. No.: WO2013/122533

PCT Pub. Date: Aug. 22, 2013

(65) Prior Publication Data

US 2015/0053076 A1 Feb. 26, 2015

(30) Foreign Application Priority Data

Feb. 17, 2012 (SE) ..... 1250135

(51) Int. Cl.
*B25D 9/12* (2006.01)
*B25D 9/14* (2006.01)
*F15B 1/18* (2006.01)

(52) U.S. Cl.
CPC ..... *B25D 9/12* (2013.01); *B25D 9/145* (2013.01); *F15B 1/18* (2013.01);
(Continued)

(58) Field of Classification Search
CPC ..... B25D 9/12; B25D 9/145
(Continued)

(56) References Cited

U.S. PATENT DOCUMENTS 3,903,972 A * 9/1975 Bouyoucos ..... B25D 9/12 173/105
4,012,909 A 3/1977 Hibbard
(Continued)

FOREIGN PATENT DOCUMENTS

AU 8882791 A 6/1992
EP 0947293 A2 10/1999
WO WO-2008036019 A1 3/2008

OTHER PUBLICATIONS

PCT/ISA/210—International Search Report—May 28, 2013 (Issued in PCT/SE2013/050111).
(Continued)

*Primary Examiner* — Thomas E Lazo
(74) *Attorney, Agent, or Firm* — Venable LLP; Eric J. Franklin

(57) ABSTRACT

A pressure accumulator for connection to a hydraulic fluid-driven percussion device. The percussion device includes at least one impact piston arranged to carry out a reciprocating motion caused by the pressure from the hydraulic fluid. The pressure accumulator is arranged in communication with a hydraulic fluid space of the impact piston. The pressure accumulator includes a space that extends at least partly around the impact piston when the pressure accumulator is mounted on the percussion device. A partition divides the space into two separate pressure chambers so that the pressure chambers are located an axial direction of the impact piston in relation to each other when the pressure accumulator is mounted on the percussion device. A first of the two separate pressure chambers is intended to be filled with a compressible medium. A second pressure chamber is in fluid communication with the hydraulic fluid space of the impact piston.

14 Claims, 1 Drawing Sheet

(52) U.S. Cl.
CPC . *F15B 2201/205* (2013.01); *F15B 2201/3151* (2013.01); *F15B 2201/43* (2013.01)

(58) Field of Classification Search
USPC ..... 92/142; 60/371
See application file for complete search history.

(56) References Cited

U.S. PATENT DOCUMENTS

| | | | | | |
|---|---|---|---|---|---|
| 4,062,268 | A * | 12/1977 | Hibbard | B25D 9/12 | 91/165 |
| 4,380,901 | A * | 4/1983 | Rautimo | B25D 9/12 | 60/418 |
| 4,552,227 | A * | 11/1985 | Wohlwend | B25D 9/145 | 173/15 |
| 4,784,228 | A * | 11/1988 | Ito | B25D 9/145 | 173/208 |
| 2013/0186667 | A1 * | 7/2013 | Pettersson | B25D 9/145 | 173/208 |

OTHER PUBLICATIONS

PCT/ISA/237—Written Opinion of the International Searching Authority—May 28, 2013 (Issued in PCT/SE2013/050111).

* cited by examiner

PRESSURE ACCUMULATOR AND PERCUSSION DEVICE

CROSS-REFERENCE TO RELATED APPLICATIONS

This application claims priority to Swedish patent application 1250135-9 filed 17 Feb. 2012 and is the national phase under 35 U.S.C. §371 of PCT/SE2013/050111 filed 11 Feb. 2013.

TECHNICAL FIELD

The present invention concerns a pressure accumulator and a hydraulic percussion device, for example an impact hammer, which comprises at least one such accumulator.

BACKGROUND OF THE INVENTION

A hydraulic percussion device often needs a pressure accumulator in order to even out pressure variations which arise from when the percussion device is in use. Pressure accumulators constitute a pressure-tight space, which is divided into at least two separate smaller spaces, for example by means of a pressure-tight membrane. A predetermined gas pressure is applied to a first side of the membrane. The pressurized gas may for example be nitrogen or some other suitable gas. A pressurized fluid that drives the membrane forwards may be provided on the second side of the membrane, which means that the pressure medium (the pressurized gas) on the first side of the membrane will be compressed. The pressure accumulator at the same time stores energy that can be released when required to provide pressurized fluid to a desired destination. In this way a certain volume of pressurized fluid may be stored in the accumulator.

Normally an accumulator is placed at the side of a hydraulic percussion device, above a hydraulic percussion device, i.e. axially behind the percussion device's impact piston chamber. A disadvantage with such solutions is that the part of the accumulator that projects out from the rest of the percussion device is exposed to impacts and to environmental effects. Such solutions also make the percussion device harder to handle. Furthermore, if a pressure accumulator is provided on an extension of a percussion device, the total length of the percussion device will be longer, which is of course a disadvantage for its use.

European patent number EP 0 947 293 discloses a device in connection to a hydraulic fluid driven percussion device, which percussion device comprises at least a frame and an impact piston. The impact piston is arranged to carry out a reciprocating motion caused by the pressure from the pressurized fluid, and further means to feed pressurized fluid to, and away from the percussion device, and a pressure accumulator in communication with the impact piston's pressurized fluid space. The pressure accumulator is along its entire length substantially formed as a ring-shaped space that surrounds the impact piston, by mounting a separate bushing around the frame which has a ring-shaped cavity. The ring-shaped space around the impact piston is arranged to be divided into two pressure chambers that are separated from one another by a bushing-like elastic membrane, whereby the first pressure chamber is intended to be filled with a compressible pressurized medium, and the second pressure chamber is in fluid communication with some pressurized fluid space of the impact piston via at least one channel that extends in the percussion device's radial direction. The frame's periphery is provided with a first ring-shaped cavity to form the first pressure chamber and the bushing is, in a corresponding way, provided with a second ring-shaped cavity to form the second pressure chamber. The bushing-like membrane is arranged between the frame and the bushing.

A disadvantage with the accumulator that is described in European patent number EP 0 947 293 is that if one wants to achieve a higher initial charging pressure in the accumulator, it has to contain a lot of small channels that extend in the radial direction, and the holes at the end of each channel have to be sufficiently small so that the membrane will not be driven into the holes and break when the accumulator is in use. The membrane can namely be subjected to large stresses and deformations, which means that the membrane material can have an unnecessarily short lifetime. Such a device can therefore be complex and time consuming to manufacture, and when the membrane contained therein breaks, there will be a stop in operation, which creates extra work and costs.

Another problem with the solution above is that the pressure accumulator that works in a radial direction can increase the total width of the percussion device, which can be a disadvantage when using a percussion device that has to be moved or used along and/or inside a narrow channel/a narrow hole, such as a percussion drilling machine.

SUMMARY OF THE INVENTION

An object of the present invention is to provide an improved pressure accumulator for connection to a hydraulic fluid-driven percussion device that comprises at least one impact piston that is arranged to, in an impact piston chamber, carry out a reciprocating motion caused by the pressure from the hydraulic fluid, whereby the pressure accumulator is arranged in communication with the impact piston's hydraulic fluid space. This object is achieved by a pressure accumulator that comprises a space that extends around the impact piston when the pressure accumulator is mounted on the percussion device, i.e. this space is arranged to at least partly extend around the impact piston chamber in which the percussion device moves when the pressure accumulator is mounted on the percussion device without projecting axially out from the back of the impact piston chamber. The space is, by means of a partition, divided into two separate pressure chambers so that the pressure chambers are located in the impact piston's axial direction in relationship to each other when the pressure accumulator is mounted on the percussion device. A first of the two separate pressure chambers is intended to be filled with a compressible medium, and a second pressure chamber is in fluid communication with the impact piston's hydraulic fluid space, for example via a slide valve.

Such a pressure accumulator can be initially charged with a high initial charging pressure (of at least 15 bar) and is simple to manufacture. The pressure accumulator does not project out from the rest of the hydraulic percussion device and is thereby not exposed to impacts and environmental effects. The lack of such a projection makes the percussion device more compact and easier to handle. Additionally, its total length does not need to be extended.

According to an embodiment of the invention the space is a ring-shaped space.

According to another embodiment of the invention the partition comprises a membrane.

According to an embodiment of the invention the pressure accumulator comprises a membrane support that is arranged to move with the membrane, i.e. the membrane is arranged to lie against the membrane support and the membrane support is arranged to follow the membrane's reciprocating motion. According to an embodiment of the invention the membrane support is suspended on at least one spring.

According to another embodiment of the invention the membrane comprises strengthening means.

According to a further embodiment of the invention the pressure accumulator comprises at least one channel for hydraulic fluid, which at least one channel is in fluid communication with the impact piston's hydraulic fluid space, for example via a slide valve. According to another embodiment of the invention the pressure accumulator comprises a plurality of channels that is in fluid communication with the impact piston's hydraulic fluid space and that is arranged symmetrically around the at least one impact piston when the pressure accumulator is mounted on the percussion device. Hydraulic fluid therefore comes in symmetrically around the impact piston, which results in smaller side forces on the impact piston. The channel/channels extend(s) preferably directly between the impact piston's hydraulic fluid space and the second pressure chamber of the pressure accumulator substantially along the shortest possible path. Pressure drop losses with such short channels will be small.

According to an embodiment of the invention the pressure accumulator is arranged to be initially charged with a working pressure of at least 15 bar, preferably at least 20 bar, most preferably at least 30 bar, or even more preferably at least 40 bar or higher.

According to another embodiment of the invention the at least one impact piston is arranged to be operated at a frequency of at least 10 Hz, or at least 50 Hz, preferably at least 60 Hz, most preferably at least 70 Hz, or even more preferably at least 80 Hz or higher.

The present invention also concerns a hydraulic fluid-driven percussion device that contains at least one pressure accumulator according to any of the embodiments of the invention.

According to an embodiment of the invention the hydraulic fluid-driven percussion device comprises a rear portion and the least one pressure accumulator is integrated in the percussion device's rear portion or mounted on the percussion device's rear portion.

BRIEF DESCRIPTION OF THE DRAWINGS

In the following, the present invention will be described in more detail with reference to the accompanying schematic figures, in which.

It should be noted that the drawings have not necessarily been drawn to scale and that the dimensions of certain details may have been exaggerated for the sake of clarity.

DETAILED DESCRIPTION OF THE EMBODIMENTS

Figure 1:
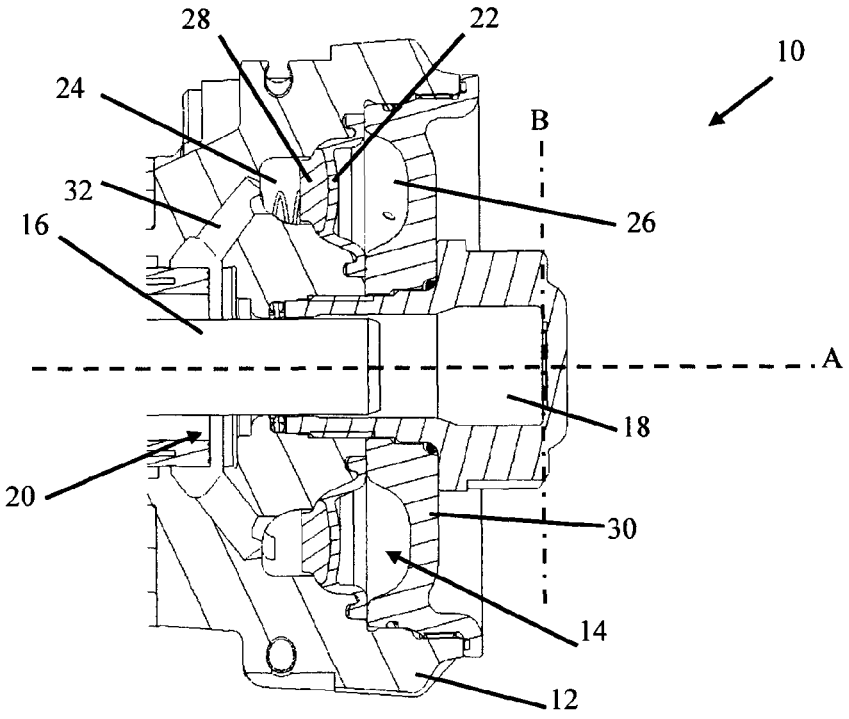
FIG. 1 shows a pressure accumulator in a hydraulic fluid-driven percussion device according to an embodiment of the present invention.

FIG. 1 shows the back part of a hydraulic fluid-driven percussion device 10 according to an embodiment of the present invention. The percussion device 10 comprises a rear portion 12 and a pressure accumulator 14 is integrated into the rear portion 12. The percussion device 10 comprises an impact piston 16 that is arranged to, in an impact piston chamber 18 whose upper impact space 20 is shown in FIG. 1, carry out a reciprocating motion caused by the pressure from the hydraulic fluid. The pressure accumulator 14 is arranged in communication with the impact piston's hydraulic fluid space via a slide valve.

The pressure accumulator 14 comprises a space, preferably a ring-shaped space, that extends around the impact piston 16, i.e. the whole of this ring-shaped space is arranged to extend around the impact piston chamber 18 in which the percussion device moves when the pressure accumulator 14 is mounted on the percussion device 10 without projecting out axially in front of or behind the back side B of the impact piston chamber 18. The ring-shaped space is, by means of a membrane 22, divided into two separate pressure chambers 24, 26 so that the pressure chambers are located in the impact piston's 16 axial direction A in relation to each another, whereby a first pressure chamber 26 is intended to be filled with a compressible medium, and a second pressure chamber 24 is in fluid communication with the impact piston's hydraulic fluid space via a slide valve.

The pressure accumulator 14 in the embodiment shown in FIG. 1 comprises a membrane support 28 that is arranged to move with the membrane 22 in the axial direction A. FIG. 1 shows that the membrane 22 lies against the membrane support 28. The membrane support 28 can comprise metal and/or plastic and/or any other suitable material, and is arranged to follow the membrane's 22 reciprocating motion when the accumulator 10 is in use. In the illustrated embodiment, the membrane support 28 is suspended on at least one spring. The first pressure chamber 26 is filled with a gas, such as nitrogen, to a predetermined gas pressure. The percussion device's hydraulic fluid is supplied to the second pressure chamber 24 to drive the membrane 22 and the membrane support 28 back and forth in an axial direction when the percussion device 10 is in use, which means that the volume taken up by the pressurized gas in the first pressure chamber 26 expands or contracts.

The membrane 22 is for example a thin film or disc that comprises en elastomer (rubber), such as nitrile rubber, neoprene rubber, polyurethane, or fluoro-rubber for example, and that seals the first pressure chamber 26 from the second pressure chamber 24 in a leak-free and pressure-tight manner. The membrane 22 can comprise strengthening means, such as a thicker section and/or metal and/or carbon fibre thread. The membrane 22 can be fixedly clamped between the rear portion 12 and a screwed accumulator lid 30, or can be fastened in the percussion device 14 in some other suitable manner. The membrane 22 may for example be substantially flat, cup- or bellow-like.

The pressure accumulator 14 preferably contains a plurality of channels 32 that is in fluid communication with the impact piston's hydraulic fluid space via the slide valve and that is arranged symmetrically around the at least one impact piston 16. Hydraulic fluid therefore comes in symmetrically around the impact piston 16, which results in smaller side forces on the impact piston 16 and piston chamber 18. The channels 32 preferably extend directly between the impact piston's hydraulic fluid space and the second pressure chamber 24 along the shortest possible path. Such short symmetrical channels 32 result in small pressure losses and symmetrical reaction forces on the impact piston 16. According to an embodiment of the invention a slide valve may be placed therebetween to control the impact piston.

According to an embodiment of the invention the pressure accumulator 14 is arranged to be initially charged with a working pressure of at least 15 bar and the impact piston 16 is arranged to be operated at a frequency of at least 10 Hz.

In the embodiment illustrated in FIG. 1 the membrane 22 is ring-shaped, and the ring-shaped space that is divided two pressure chambers (24 and 26) by the membrane 22 constitutes one single space. It should however be noted that the ring-shaped space (24 and 26) can be constituted by a plurality of connected or completely isolated spaces arranged to extend substantially around the whole impact piston 16, which spaces contain one or a plurality of membranes 22.

Figure 2:
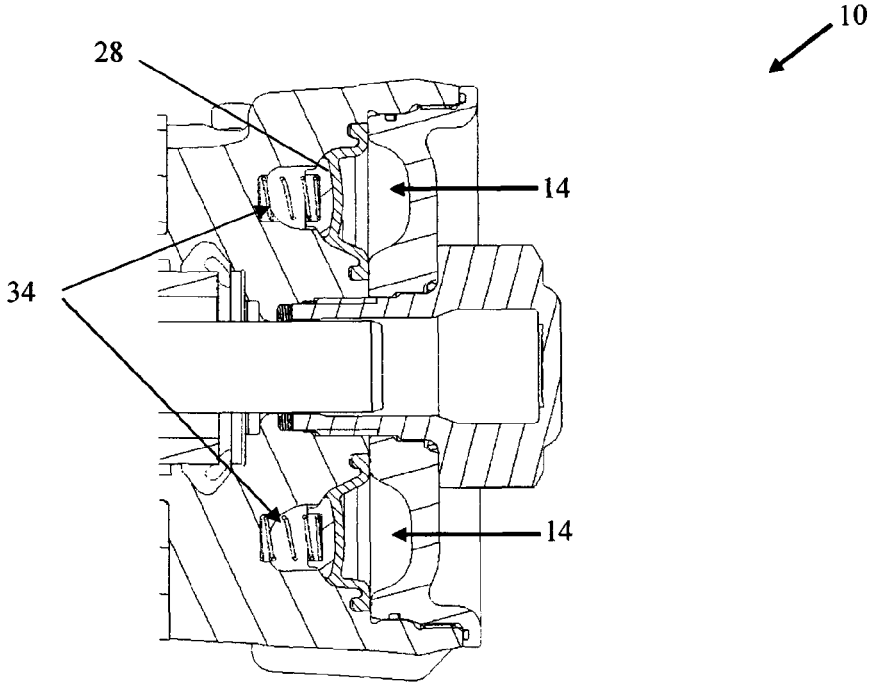
FIG. 2 shows a pressure accumulator in a hydraulic fluid-driven percussion device according to another embodiment of the present invention.

FIG. 2 shows the back part of a hydraulic fluid-driven percussion device 10 according to another embodiment of the present invention in which the percussion device 10 comprises a plurality of individual pressure accumulators 14 according to an embodiment of the invention where the membrane support 28 is suspended on springs 34. Preferably, an even number of pressure accumulators 14 may be arranged symmetrically around the impact piston 16.

Several modifications of the invention would be possible within the scope of the accompanying claims. For example, even though the illustrated embodiments are directed to a membrane 22 that separates two pressure chambers 24, 26 from each other, a piston could be used instead of a membrane 22.

The invention claimed is:

1. A pressure accumulator for connection to a hydraulic fluid-driven percussion device, wherein the percussion device comprises at least one impact piston that is arranged to carry out a reciprocating motion caused by pressure from hydraulic fluid, whereby said pressure accumulator is arranged in communication with a hydraulic fluid space of the impact piston, said pressure accumulator comprising:

a space that extends at least partly around said impact piston when said pressure accumulator is mounted on said percussion device, and a partition configured to divide the space into two separate pressure chambers so that the pressure chambers are located in an axial direction of the impact piston in relation to each other when said pressure accumulator is mounted on said percussion device, whereby a first of said two separate pressure chambers is intended to be filled with a compressible medium, and a second pressure chamber is in fluid communication with the hydraulic fluid space of the impact piston.

2. The pressure accumulator according to claim 1, wherein said space is a ring-shaped space.

3. The pressure accumulator according to claim 1, wherein said partition comprises a membrane.

4. The pressure accumulator according to claim 3, further comprising:

a membrane support that is arranged to move with said membrane.

5. The pressure accumulator according to claim 4, further comprising:

at least one spring from which said membrane support is suspended.

6. The pressure accumulator according to claim 3, wherein said membrane comprises a strengthening element.

7. The pressure accumulator according to claim 1, further comprising:

at least one channel for hydraulic fluid, which channel is in fluid communication with the hydraulic fluid space of the impact piston.

8. The pressure accumulator according to claim 7, wherein said at least one channel extends between the hydraulic fluid space of the impact piston and said second pressure chamber substantially along the shortest possible path.

9. The pressure accumulator according to claim 1, further comprising:

a plurality of channels for hydraulic fluid, which channels are in fluid communication with the hydraulic fluid space of the impact piston and are arranged symmetrically around said at least one impact piston when the pressure accumulator is mounted on said percussion device.

10. The pressure accumulator according to claim 1, wherein the pressure accumulator is arranged to be initially charged with a working pressure of at least 15 bar.

11. The pressure accumulator according to claim 1, wherein said at least one impact piston is arranged to be operated at a frequency of at least 10 Hz.

12. A hydraulic fluid-driven percussion device, comprising:

at least one impact piston that is arranged to carry out a reciprocating motion caused by pressure from hydraulic fluid, at least one pressure accumulator arranged in communication with a hydraulic fluid space of the impact piston, said pressure accumulator comprising a space that extends at least partly around said impact piston when said pressure accumulator is mounted on said percussion device, and a partition configured to divide the space into two separate pressure chambers so that the pressure chambers are located in an axial direction of the impact piston in relation to each other when said pressure accumulator is mounted on said percussion device, whereby a first of said two separate pressure chambers is intended to be filled with a compressible medium, and a second pressure chamber is in fluid communication with the hydraulic fluid space of the impact piston.

13. The hydraulic fluid-driven percussion device according to claim 12, further comprising:

a rear portion, wherein said at least one pressure accumulator is integrated into the rear portion of said percussion device.

14. The hydraulic fluid-driven percussion device according to claim 12, further comprising:

a rear portion, wherein said at least one pressure accumulator is mounted on the rear portion of said percussion device.

* * * * *